United States Patent [19]

Cimins

[11] 3,965,652

[45] June 29, 1976

[54] MACHINE FOR COVERING A PALLET LOAD WITH SHRINKABLE PLASTIC FILM

[75] Inventor: John B. Cimins, Paterson, N.J.

[73] Assignee: J & H Co., Paterson, N.J.

[22] Filed: Oct. 30, 1969

[21] Appl. No.: 872,592

[52] U.S. Cl. ..... 53/183; 53/386

[51] Int. Cl.[2] ..... B65B 43/30; B65B 53/02

[58] Field of Search ..... 53/30, 33, 24, 183, 53/159, 187, 241, 256, 259, 184, 386, 389

[56] References Cited

UNITED STATES PATENTS

| | | | |
|---|---|---|---|
| 3,112,586 | 12/1963 | Luetzow | 53/256 X |
| 3,210,909 | 10/1965 | Cochrane | 53/256 |
| 3,308,601 | 3/1967 | Masters | 53/256 |
| 3,429,095 | 2/1969 | Huson | 53/24 |
| 3,508,375 | 4/1970 | Myers | 53/30 |
| 3,522,688 | 8/1970 | Kaliwoda et al. | 53/30 |
| 3,579,948 | 5/1971 | Lerner | 53/183 X |

*Primary Examiner*—Roy Lake
*Assistant Examiner*—E. F. Desmond
*Attorney, Agent, or Firm*—Lerner, David, Littenberg & Samuel

[57] ABSTRACT

A loaded pallet is carried on a conveyor belt under a support frame carrying one or more rolls of double-layer plastic film. Motor driven drive rollers engage the end of a roll and draw it down where it is engaged by suction heads on opposite sides of the film. The suction heads carried by motor driven flexible suction ducts are moved down on opposite sides of the load to enclose the loaded pallet. A heater assembly fuses a seam in the film above the load and a cutter cuts the film above the seam. The suction ducts may have articulated duct sections. The film is folded flat on a roll and may be tubular or open at one lateral edge.

7 Claims, 25 Drawing Figures

INVENTOR.
JOHN B. CIMINS
BY Polachek & Saulsbury
ATTORNEYS

INVENTOR.
JOHN B. CIMINS
BY Polachek & Saulsbury
ATTORNEYS

INVENTOR.
JOHN B. CIMINS
BY Polachek & Saulsbury
ATTORNEYS

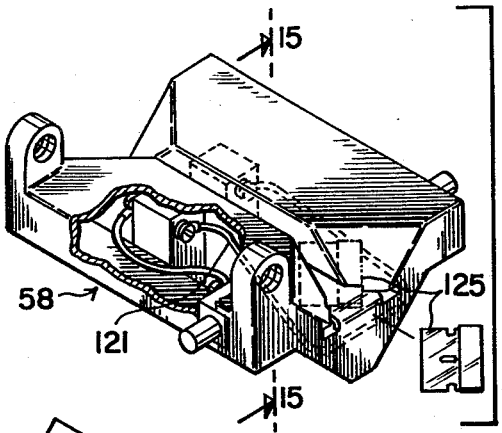
Fig. 14.
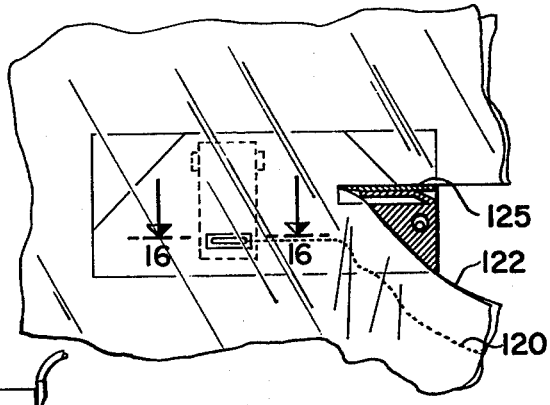
Fig. 15.
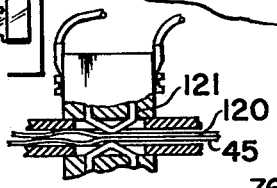
Fig. 16.
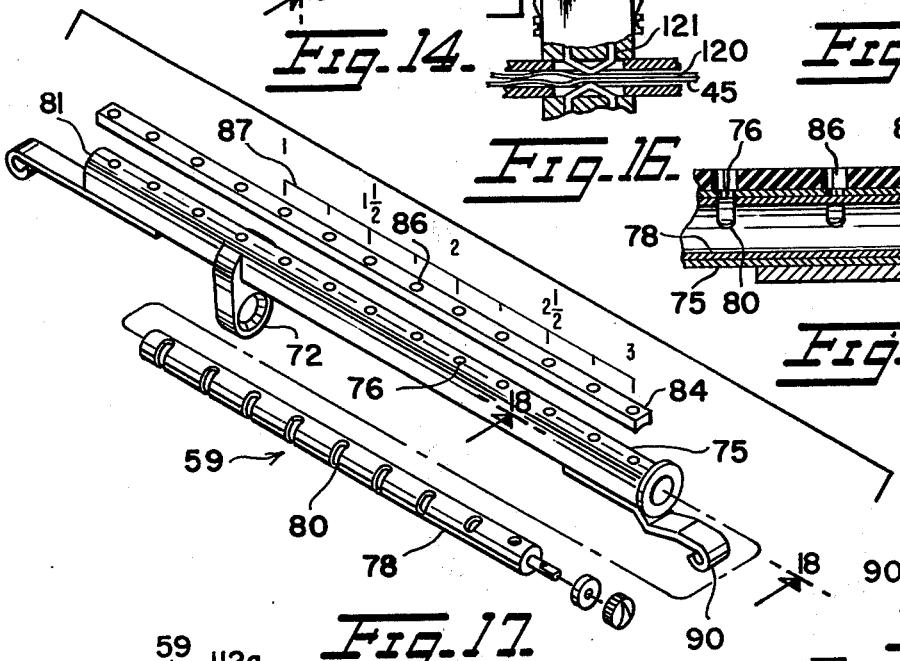
Fig. 17.
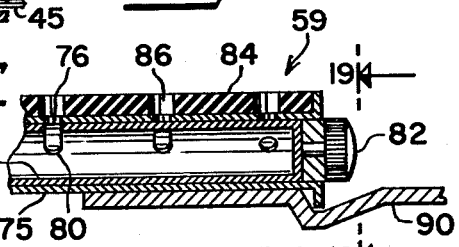
Fig. 18.
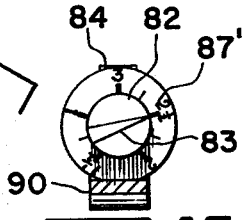
Fig. 19.
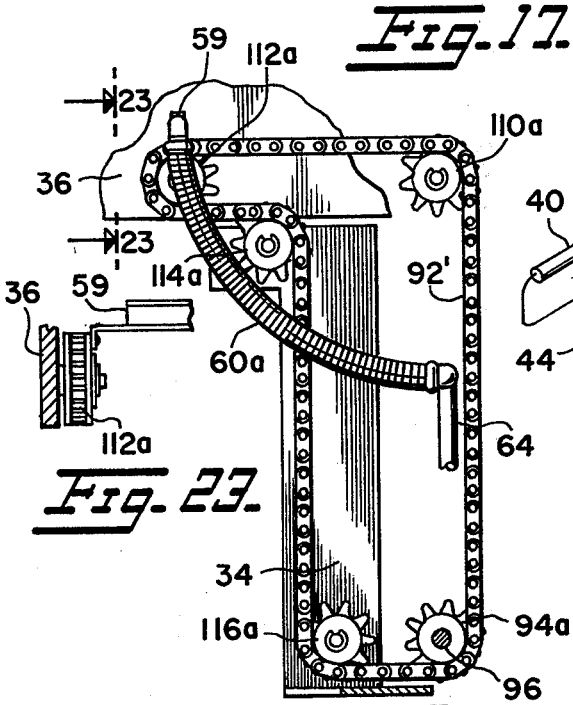
Fig. 23.
Fig. 22.
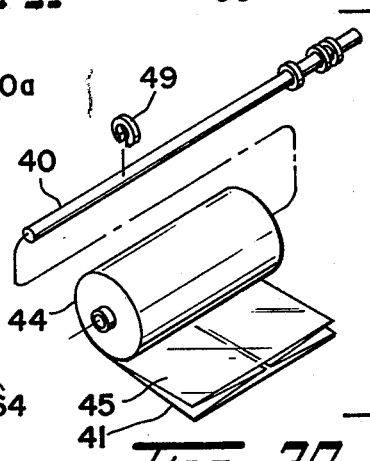
Fig. 20.
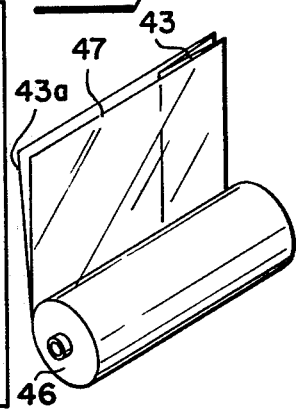
Fig. 21.
INVENTOR.
JOHN B. CIMINS
BY Polachek & Saulsbury
ATTORNEYS

MACHINE FOR COVERING A PALLET LOAD WITH SHRINKABLE PLASTIC FILM

This invention concerns a machine for covering a pallet load with shrinkable plastic film.

It has been proposed heretofore to cover a bulk load on a pallet with shrinkable film. The covered load and pallet are conveyed through an oven where the film shrinks around the load and pallet. A considerable amount of hand labor is required to cover the loaded pallet with the plastic film prior to the heat treatment in the oven. This invention is directed at minimizing the amount of hand labor required in covering the loaded pallet.

According to the invention, a machine is provided in which flat, double-layer plastic film is mechanically drawn down over a loaded pallet and automatically cut. The covered load is then conveyed into a conventional oven for heat treating the film to shrink it around the load.

The use of transparent plastic films made of polyethyelene, polystyrene, rubber hydrochloride or other heat shrinkable material for covering packages has become rather widespread in many industries. However, the machines used for covering the packages are adapted only for handling small articles. Machines of this type are described in such U.S. Pat. Nos. as 3,156,812 and 3,381,443. The present invention fulfills the need for a machine to wrap a transparent, plastic, heat shrinkable film around a large bulk load on a pallet.

The invention will be explained in detail in connection with the drawing, wherein:

FIG. 14 is a perspective view with parts broken away of a film guide, seamer and cutting head.

FIG. 15 is a vertical sectional view taken on line 15—15 of FIG. 14.

FIG. 16 is a fragmentary horizontal sectional view taken on line 16—16 of FIG. 15.

FIG. 17 is an exploded perspective view of parts of a suction head assembly.

FIG. 18 is an enlarged fragmentary longitudinal sectional view taken on line 18—18 of FIG. 17, showing parts of the suction head assembly.

FIG. 19 is an end elevational view, partially in section taken on line 19—19 of FIG. 18.

FIG. 20 is an exploded perspective view of a roll of tubular plastic film and supporting shaft, the film having inwardly folded opposite edges.

FIG. 21 is a perspective view similar to a part of FIG. 20 showing a roll of double layer plastic film with one edge folded inwardly.

FIG. 22 is a fragmentary side view of another suction duct assembly.

FIG. 23 is a fragmentary end view taken on line 23—23 of FIG. 22.

FIG. 24 is a simplified diagram of an electrical control circuit of the machine.

Figures 1, 1A, 2A:
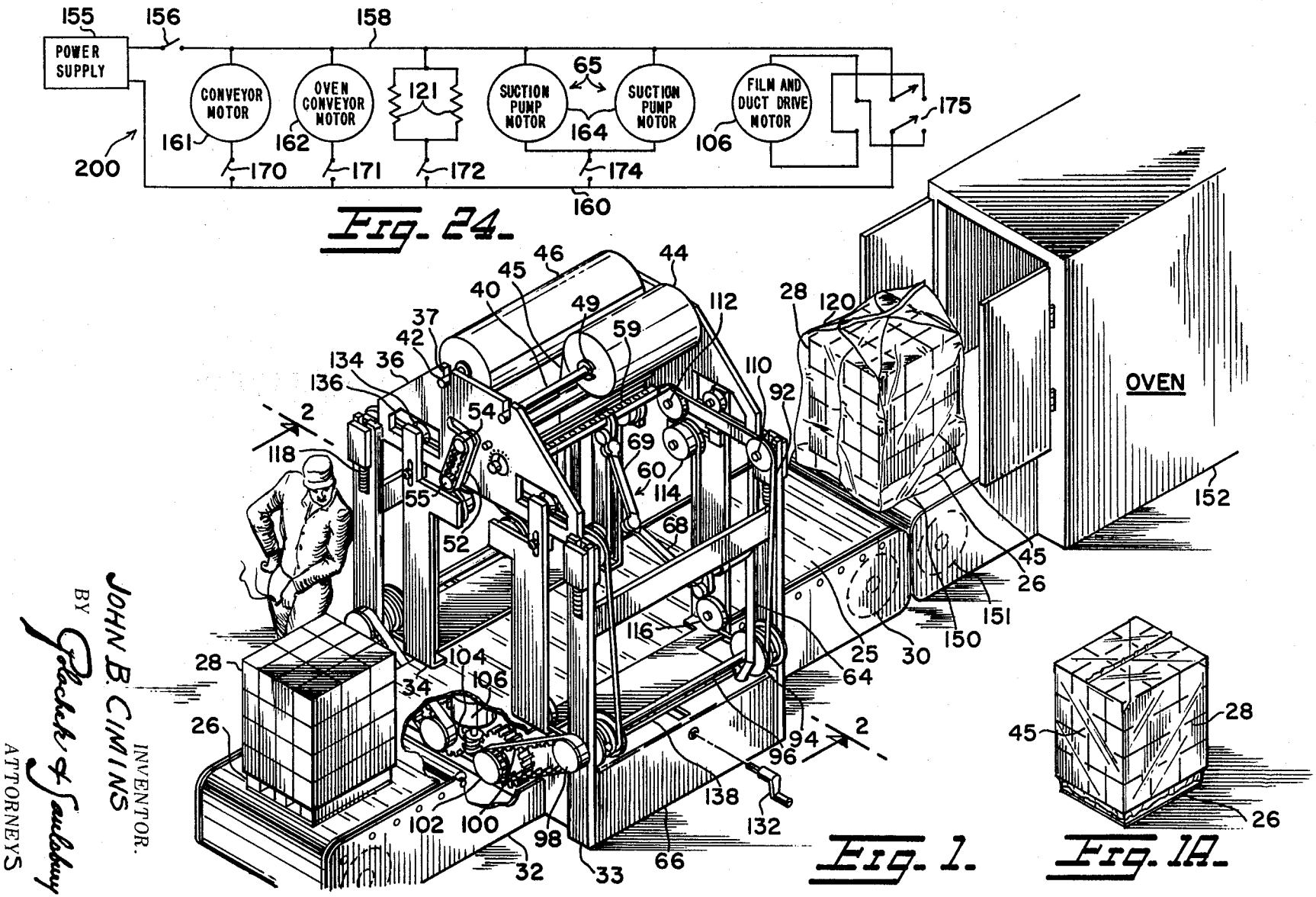
FIG. 1 is a perspective view of a machine embodying the invention for covering a pallet load with plastic film, the machine being shown with an associated oven for shrinking the film on the loaded pallet.
FIG. 1A is a perspective view of a film-wrapped loaded pallet after the film is heat-shrunk on the load.
Figure 2:
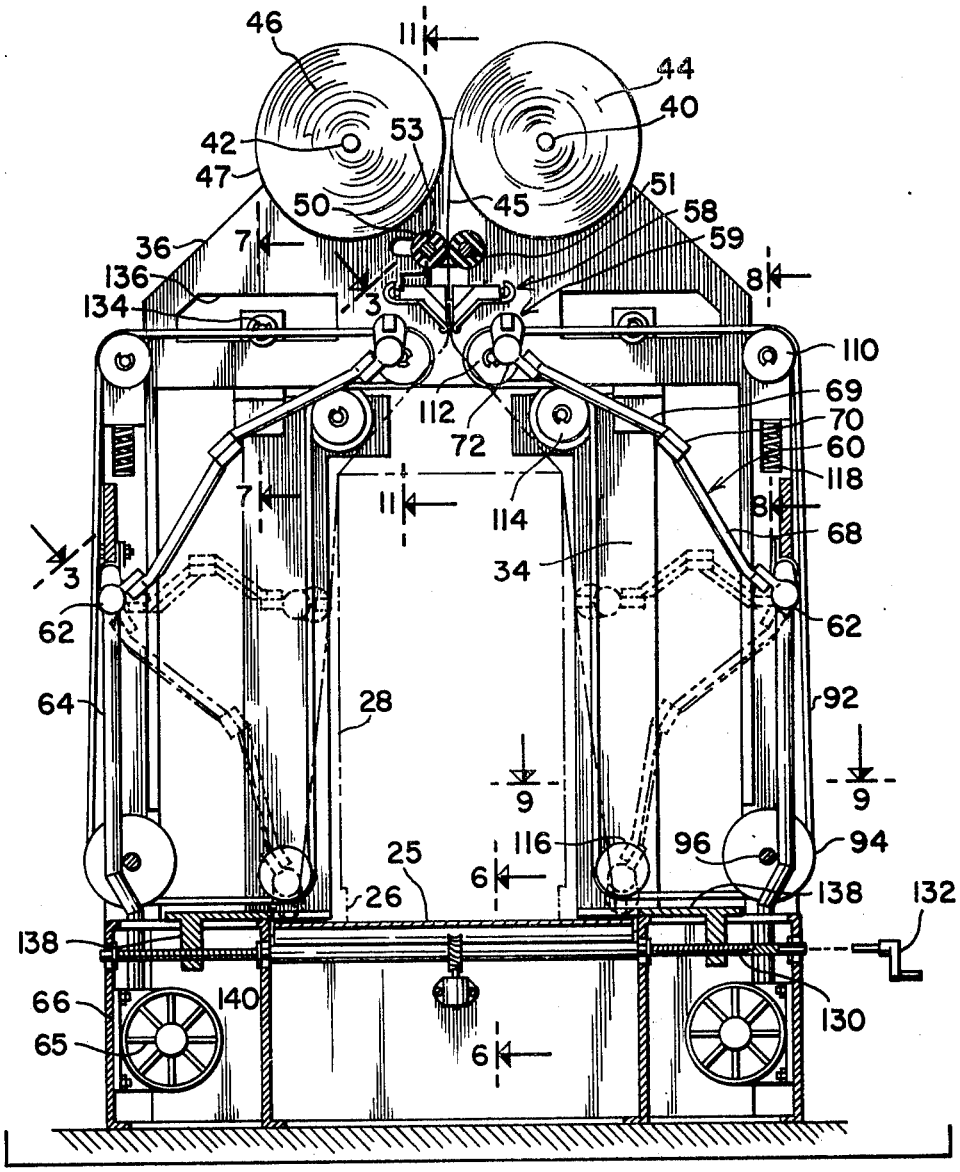
FIG. 2 is an enlarged vertical cross sectional view of the machine, taken on line 2—2 of FIG. 1.

Referring first to FIGS. 1 and 2, there is shown a machine embodying the invention. The machine includes a horizontal conveyor belt 25 on which a pallet 26 can be movably supported. The belt is supported on rollers 27; see FIG. 6. The pallet carries a bulky load 28. This load may consist of a plurality of bags, boxes, packages or other containers or articles of regular shape. Alternatively the load can be a stack of irregularly shaped articles or a single article. The load can be 3, 4, 5 or more feet in height. The belt moves on motor driven rollers 30 at opposite ends of conveyor 32.

The machine has vertical frame members 33, 34 spaced apart at opposite edges of the belt. Frame members 33 are integral with vertical frame plates 36. These frame plates rotatably support shafts 40, 42 carrying plastic film rolls 44, 46. Roll 44 is axially shorter than roll 46 and has narrower film 45. Roll 46 has wider film 47. Either film 45 or 47 can be wrapped around a pallet load depending on the size of the load. The film 45 of roll 44 may be tubular in form as best shown in FIG. 20. Opposite edges 41 of the film are folded inwardly. Shaft 40 is axially inserted through the roll which is engaged by spring washers 49 at opposite ends to hold it in place on the shaft. Shafts 40 and 42 are removably supported in slots 37 at upper edges of frame plates 36. The longer roll 46 may have a double layer of film 47 as best shown in FIG. 21. This film may have a double fold 43 at one edge. The other edges 43a of the film may be detached from each other. This arrangement of film 47 makes it possible to drape the film around larger or irregularly shaped loads which cannot be enclosed by the narrower tubular film 45 of roll 44.

Figure 11:
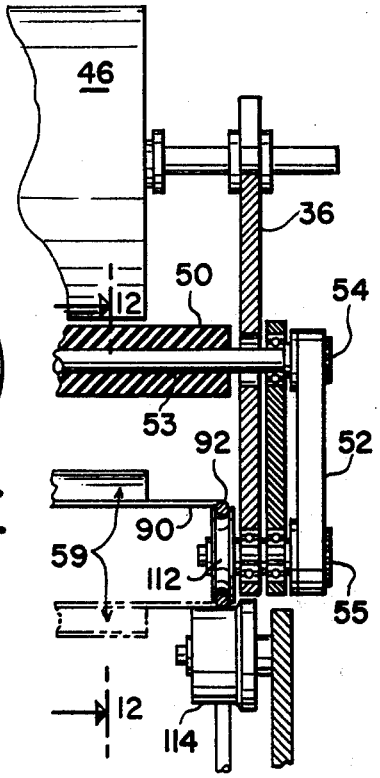
FIG. 11 is an enlarged fragmentary vertical sectional view taken on line 11—11 of FIG. 2, showing parts of a film supply roll and film cutting mechanism.
Figure 13:
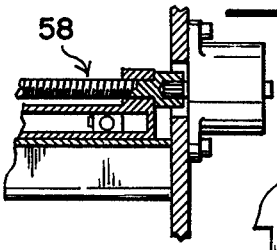
FIG. 13 is a fragmentary vertical sectional view taken on line 13—13 of FIG. 12.
Figure 12:
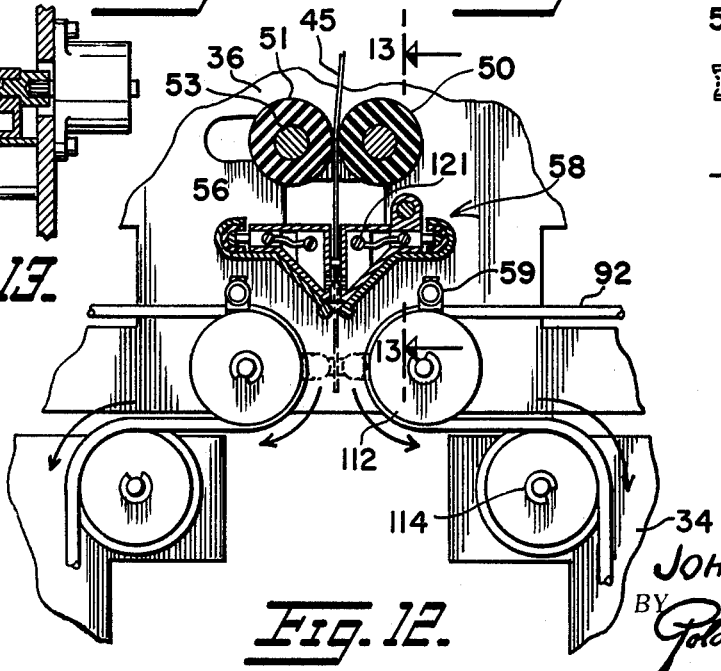
FIG. 12 is fragmentary vertical sectional view taken on line 12—12 of FIG. 11, showing parts of the film cutting mechanism.

FIGS. 1 and 2 show film 45 being drawn from roll 44. The film passes down between friction gripping rollers 50 and 51 journaled in plates 36. Roller 50 is motor driven via a belt 52 engaged on pulleys 54, 55; see FIGS. 11, 12. Pulley 54 is mounted on shaft 53 which carries roller 50. The film passes between generally triangular parts 56 of a seamer and cutter head assembly 58 which is used to form a top seam and to sever the film transversely.

Figure 3:
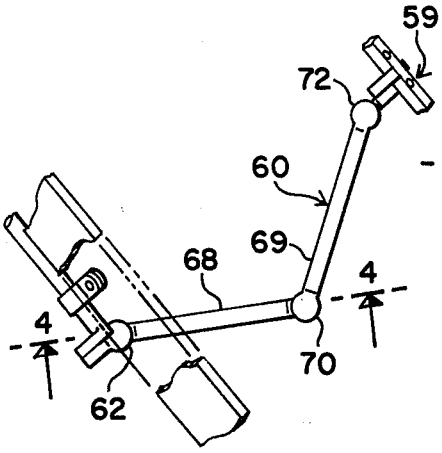
FIG. 3 is a fragmentary sectional view, with portions broken away, taken on line 3—3 of FIG. 2, showing parts of an articulated, suction duct.
Figure 4:
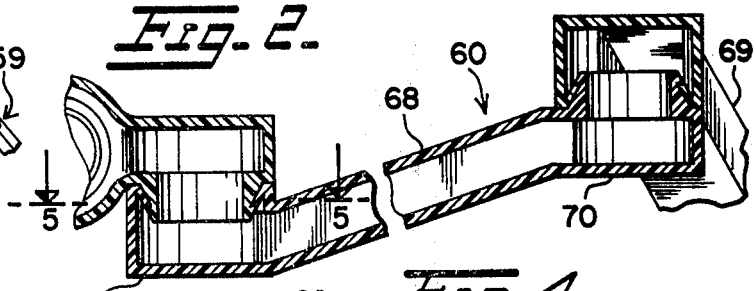
FIG. 4 is a further enlarged sectional view taken on line 4—4 of FIG. 3.
Figure 5:
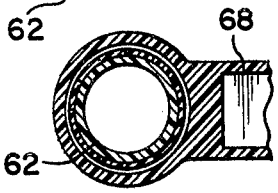
FIG. 5 is a fragmentary sectional view taken on line 5—5 of FIG. 4.

The tubular or double-layer film is spread apart by suction heads 59 mounted at the ends of articulated hollow suction pipes or ducts 60. The suction heads 59 draw the film down enclosing the load 28 and pallet 26, shown in dotted lines in FIG. 2. The ducts 60 are rotatable through an angle of about 90° around a swivel joint 62; see FIGS. 3, 4 and 5. The joint 62 is located at the upper end of a stationary pipe 64 which extends vertically upward from a suction pump 65 located in the base 66 of the machine below the conveyor belt. Each duct has two hollow duct sections 68, 69 pivotally connected by a swivel joint 70. Suction head 59 is connected by a swivel joint 72 to duct section 69.

FIGS. 17, 18 and 19 show details of the suction head 59 to best advantage. Each suction head comprises a horizontal tube 75 provided with holes 76 spaced apart axially of the tube. Inserted in tube 75 is an inner tube 78. Tube 78 has elongated openings 80 spaced circumferentially apart but registering with holes 76 in such a way that the inner tube can be turned to one position to clear the openings 76 from end 81 of tube 75 up to point "1" on scale 87 of FIG. 17. The inner tube 78 can be turned to clear successively more and more openings 76 until all openings are cleared up to point 3 on scale 87. A knob 82 is engaged on one end of tube 78 to enable turning the tube. A straight flat bar 84 is mounted on tube 75. This bar has holes 86 registering with holes 76. A scale 87' is inscribed on an annular radial flange 89 at the other end of tube 75. Knob 82 has an inscribed index pointer 83 movable around scale 87' when the knob is turned to indicate the axial length of head 59 which has clear openings 76. Scale 87' shown in FIG. 19 corresponds to scale 87 shown in FIG. 17. Part of joint 72 is shown in FIG. 17 communicating with tube 75 to apply suction to the film 45 via holes 76, 80 and 86. Straps 90 at opposite ends of tube 75 engage on drive belts 92 shown in FIGS. 1, 2, 8–12 to which reference is now made.

There are four drive belts 92. Each belt is engaged at one end on a drum 94; see FIG. 10. Two drums 94 at each side of the machine are carried by a shaft 96. There are two such shafts carrying pulleys 98 on which are toothed belts 100 engaged on drive gears 102; see FIG. 1. Gears 102 are driven by worm 104 carried by the shaft of motor 106 mounted under conveyor belt 60. From drum 94 the belts 92 extend around pulleys 110 and 112 rotatably supported by frame plates 36. Then the belts extend horizontally around pulleys 114 journaled at upper ends of frame members 34. From pulleys 114 the belts extend downwardly around pulleys 116 and back to drums 94. Pulleys 110 are loaded by springs 118 and biased upwardly to maintain tension in belts 92; see FIGS. 2 and 8.

FIG. 2 shows the suction ducts in an upwardly extending position with suction heads 59 at top positions just prior to engaging opposite sides of film 45. The suction ducts and heads are shown in successive lower positions by dotted lines, drawing down the tubular film around the load 28 and pallet 26. The articulated ducts bend at the joints while the heads 59 remain in contact with the film due to the suction provided by suction pumps 65 via suction pipes 64 and ducts 60. The heads 59 are moved down by the belts 92 to which the heads are attached at opposite ends. The belts are driven by motor 106 in electrical control circuit 200 shown in FIG. 24 and explained below.

A transverse top seam 120 shown in FIGS. 1, 1A, 14–16 is formed in the double-layer film wrapped around the load. The seam is formed by electrical heating elements 121 disposed in seamer and cutter assembly 58. The electrical heater elements 121 are disposed below film drive rollers 50, 51 as clearly shown in FIG. 9. The film is cut transversely on line 122 above seam 120 by blade 125 shown in FIGS. 14 and 15.

Figure 6:
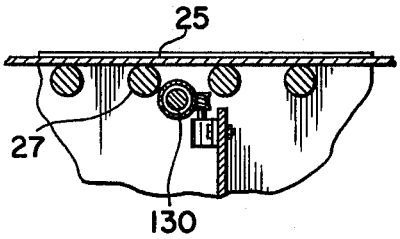
FIG. 6 is a fragmentary vertical sectional view taken through a wrapping platform, on line 6—6 of FIG. 2.
Figure 7:
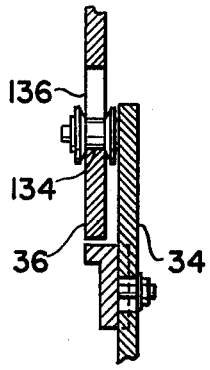
FIG. 7 is a fragmentary vertical sectional view taken on line 7—7 of FIG. 2, showing parts of an adjustable support for supply rolls of plastic film.
Figure 8:
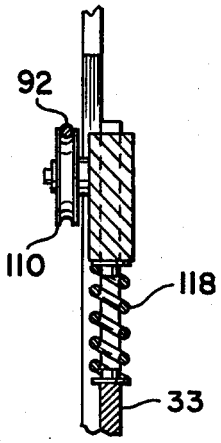
FIG. 8 is an enlarged fragmentary sectional view taken on line 8—8 of FIG. 2, showing parts of the suction duct drive mechanism.
Figure 9:
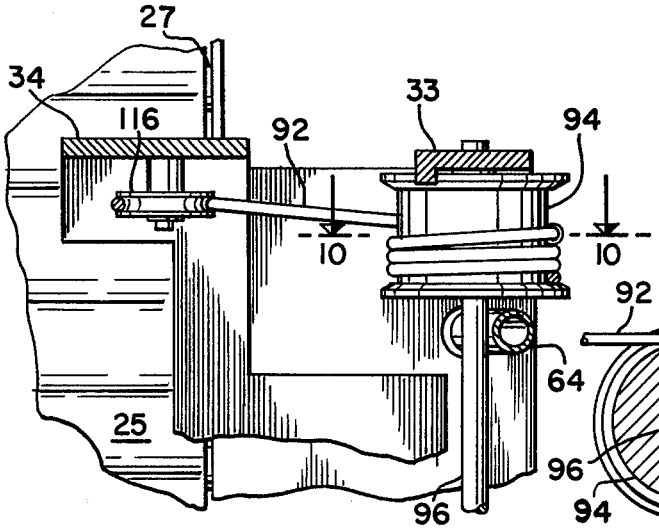
FIG. 9 is an enlarged horizontal sectional view taken on line 9—9 of FIG. 2, showing other parts of the drive mechanism of a suction duct.
Figure 10:
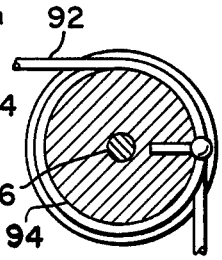
FIG. 10 is a cross sectional view taken on line 10—10 of FIG. 9, showing parts of a drum and cable.

A threaded shaft 130 turned manually by a crank 132 is provided for adjustably positioning apart frame members 34 as best shown in FIGS. 1, 2 and 6. Rollers 134 engaged on lower edges of holes 136 in frame plates 36 serve as guides for movement of the frame members 34; see FIGS. 1, 2 and 7. Platforms 138 are secured to lower ends of frame members 34 and adjustably extend over opposite edges of belt 25. Depending flanges 138 have threaded holes 140 through which threaded shaft 130 extends.

Another conveyor belt 150 is shown in FIG. 1 aligned with belt 25 to receive the loaded pallet covered by tubular film cover 45 and convey it into oven 152 where the loose cover is to be heated and shrunk around the loaded pallet. Motor driven rollers 151 carry belt 150. FIG. 1A shows the film cover 45 fitting snugly around load 28 and pallet 26 after heating and shrinking of the film in oven 152.

FIG. 24 shows in simplified form the electrical control circuit 200 of the machine. A suitable power supply 155 is provided with a main on-off switch 156 to control application of power to main line 158. Connected in parallel across power lines 158 and 160 are conveyor motors 161, 162, heater elements 121, motors 164 of suction pumps 65, and motor 106 which drives the suction ducts 60 and film drive roller 50. Switches 170, 171 are connected in series respectively with motors 161, 162. Switch 172 is connected in series with heater elements 121. Switch 174 is connected in series with motors 164. A reversing switch 175 is connected in series with motor 106.

In operation of the machine including control circuit 200, the operator will stack load 28 on pallet 26. The loaded pallet will be located at the left end of conveyor belt 25 as shown in FIG. 1. Then the operator will close switches 156 and 170 to start motor 161 which drives belt 25 to convey the loaded pallet under the film rolls 44, 46 supported above conveyor belt 25. Then switch 170 will be opened. Thereafter switch 175 will be closed to start motor 106. The rollers 50, 51 will draw the film down to the uppermost position of suction heads 59 shown in FIG. 2. Then switch 174 will be closed so that the suction heads engage opposite sides of film 45 and draw the film layers apart on opposite sides of load 28. The suction ducts and heads will move down as shown by dotted lines in FIG. 2 drawn by cables 92. The tubular film will enclose the load 28 and pallet 26. Then motors 164 will be stopped by opening switch 174 and motor 106 will be stopped by opening switch 175. Switch 172 will then be closed to energize heater elements 121. This will fuse a transverse seam 120 across the double-layer film. Switch 175 will then be opened and switches 170 and 171 will be closed to convey the loosely wrapped loaded pallet to conveyor belt 150 and into oven 152 as shown in FIG. 1. As the loaded pallet moves away from rollers 50, 51 the film will be cut by blade 125 on line 122 above seam 120 as shown in FIG. 15. Switch 175 can be closed in reversed position after the loaded pallet leaves belt 25 to reverse drive motor 106 and restore suction heads 59 to the uppermost position shown in FIG. 2. The machine will now be ready for another cycle of operation as described above.

FIGS. 22 and 23 show another arrangement for applying suction to the tubular film. In place of each articulated duct 60 there is provided a flexible suction duct 60*a* connected to fixed suction pipe 64. Chain 92' replaces belt 92. Suction heads 59 are mounted at the free ends of ducts 60*a* and are attached to chains 92'. Sprockets 94*a*, 110*a*, 112*a*, 114*a*, 116*a* replace pulleys 94, 110, 112, 114 and 116 respectively and carry chains 92'. Other parts of the machine are numbered to correspond with parts already described. Flexible ducts 60*a* move down with the chains to drawn down the film layers under suction in the same manner as already described for the articulated ducts 60.

It will be apparent that there has been provided a machine which automatically encloses loaded pallets in a flexible, heat shrinkable plastic tubular film. Hand labor is minimized during operation of the machine and is limited to opening and closing the various switches. If desired, a suitable switch timing mechanism can be provided for operating the switches automatically to eliminate substantially all manual operations involved in wrapping the film around the loaded pallet.

The electrical heating elements 121 serving to cut and seal the double layer of film are preferably made of specially shaped nichrome wire bent to the desired shape with the film passing the heating elements 121 at a regulated speed so that either a bag or a tube will have been made.

What is claimed is:

1. Bulk shrink film packaging apparatus comprising:

a. a frame having load supporting means therein for supporting a load to be wrapped;

b. sheet feeding means for feeding tubular sheet downwardly toward said load supporting means; and c. tube-gripping and holding means movable in opposite directions from the plane of the descending flat tubular sheet and positioned at a level above the load to be wrapped and below the sheet feeding means, said tube-gripping means being arranged to engage opposite sides of the flat tubular sheet as it is fed downwardly and spread them apart to form the sheet into a four-sided configuration and then hold it in said configuration and guide it downwardly around the load as the sheet-feeding means continues to feed the sheet downwardly, said load supporting means including conveyor means for supporting a loaded pallet, said conveyor means being operative to position a pallet load immediately below said sheet feeding means.

2. Apparatus as defined in claim 1 including cutter means for cutting said sheet transversely.

3. The apparatus of claim 1 wherein said cutter means is disposed above said tube-gripping and holding means.

4. Apparatus in accordance with claim 2, including sealing means associated with said cutter means for securing film layers together to form a transverse seam across said sheet.

5. The apparatus as defined in claim 1, wherein said tube-gripping and holding means includes suction applying members.

6. Apparatus in accordance with claim 5, wherein said suction applying members comprise flexible suction ducts.

7. A machine for wrapping a load on a pallet in heat shrinkable, tubular plastic film, comprising a support for rotatably supporting at least one roll of double-layer plastic film in an elevated axially horizontal position above a load on a pallet; motor driven roller means disposed to engage a free end of said roll for drawing the film layers from the roll; suction applying members disposed to engage the two layers of film drawn from the roll and to separate the same respectively on opposite sides of the load; motor driven means engaging said suction applying members for moving the same downwardly on opposite sides of the load; suction generating means connected to said suction applying members so that said members engage the film layers and draw the same downwardly on opposite sides of the load, conveyor means for supporting the loaded pallet; cutter means disposed below said roller means for cutting the film layers transversely above said load; sealing means disposed below said cutter means for securing the film layers together to form a transverse seam above said load, whereby the conveyor means transports the loaded pallet covered by the cut, sealed, tubular film away from said support; said suction applying members comprising suction applying heads extending transversely across the double-layer film drawn from said roll, said heads having spaced holes to apply suction to the respective layers of film, adjustment means in said heads for selectively closing certain ones of said holes and leaving other holes open depending on the width of film engaged by said heads, said suction applying members further comprising articulated suction ducts connected between said heads and said generating means.

* * * * *